US009907141B2

(12) United States Patent
Shigezane et al.

(10) Patent No.: US 9,907,141 B2
(45) Date of Patent: Feb. 27, 2018

(54) LUMINANCE CONTROL APPARATUS AND LUMINANCE CONTROL METHOD

(71) Applicants: Yazaki Corporation, Tokyo (JP); TOYOTA JIDOSHA KABUSHIKI KAISHA, Toyota-shi, Aichi-ken (JP)

(72) Inventors: Yasuyuki Shigezane, Susono (JP); Shuuji Satake, Susono (JP); Takeshi Yamashita, Makinohara (JP); Mitsuaki Maeda, Makinohara (JP); Terumitsu Sugimoto, Makinohara (JP); Yasushi Ohba, Makinohara (JP); Nobuyoshi Imaeda, Kariya (JP); Makoto Sunohara, Kariya (JP); Hisanori Katou, Kariya (JP); Masahiro Kasai, Toyota (JP)

(73) Assignees: YAZAKI CORPORATION, Minato-ku, Tokyo (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/529,278

(22) PCT Filed: Dec. 1, 2015

(86) PCT No.: PCT/JP2015/083760
§ 371 (c)(1),
(2) Date: May 24, 2017

(87) PCT Pub. No.: WO2016/104071
PCT Pub. Date: Jun. 30, 2016

(65) Prior Publication Data

US 2017/0290127 A1 Oct. 5, 2017

(30) Foreign Application Priority Data

Dec. 26, 2014 (JP) ..... 2014-265408

(51) Int. Cl.
*H05B 37/02* (2006.01)
*G09G 3/32* (2016.01)
(Continued)

(52) U.S. Cl.
CPC ..... *H05B 37/0209* (2013.01); *G09G 3/2003* (2013.01); *G09G 3/2014* (2013.01);
(Continued)

(58) Field of Classification Search
CPC ..... G09G 2320/064; G09G 2320/0233; G09G 3/32; G09G 3/3413; G09G 2320/0666;
(Continued)

(56) References Cited

U.S. PATENT DOCUMENTS 8,605,030 B2 * 12/2013 Kang ..... G09G 3/342 345/102
8,629,831 B2 * 1/2014 Park ..... G09G 3/3413 345/102
(Continued)

FOREIGN PATENT DOCUMENTS

JP 2003-257694 A 9/2003
JP 2004-311134 A 11/2004
(Continued)

OTHER PUBLICATIONS

International Search Report for PCT/JP2015/083760 dated Mar. 1, 2016.

*Primary Examiner* — Vibol Tan
(74) *Attorney, Agent, or Firm* — Sughrue Mion, PLLC

(57) ABSTRACT

A luminance control device and a luminance control method for controlling luminance of a light emitting member are provided in order to reduce the amount of information to be stored while preventing the user from feeling uncomfortable. The CPU divides by the interpolation division number a value obtained subtracting the reference duty ratio from
(Continued)

the reference duty ratio so as to calculate an interpolation variation width, and integrates the interpolation variation width to the reference duty ratio every time the interpolation period elapses, and the variation width in the luminance of the LED is therefore reduced, preventing users to feel uncomfortable, which allows for suppressing the amount of information to be stored.

5 Claims, 3 Drawing Sheets

(51) Int. Cl.

| | |
|---|---|
| ***H05B 33/08*** | (2006.01) |
| ***G09G 3/34*** | (2006.01) |
| ***G09G 3/36*** | (2006.01) |
| ***G09G 3/20*** | (2006.01) |

(52) U.S. Cl.
CPC ..... *G09G 3/342* (2013.01); *G09G 3/3406* (2013.01); *G09G 3/3413* (2013.01); *G09G 3/3426* (2013.01); *G09G 3/3433* (2013.01); *G09G 3/3648* (2013.01); *H05B 33/0815* (2013.01); *H05B 33/0866* (2013.01); *H05B 33/0893* (2013.01); *H05B 37/0227* (2013.01); *H05B 37/0281* (2013.01)

(58) Field of Classification Search
CPC ..... G09G 2360/16; G09G 3/2014; G09G 2320/0626; G09G 2320/062; G09G 5/10; H05B 37/02; H05B 33/0815; H05B 33/0845; G01J 1/32; G01J 3/46
See application file for complete search history.

(56) References Cited

U.S. PATENT DOCUMENTS

| | | | | |
|---|---|---|---|---|
| 9,053,664 | B2 * | 6/2015 | Lee | G09G 3/32 |
| 9,293,088 | B2 * | 3/2016 | Yoshida | G09G 3/2022 |
| 9,363,872 | B2 * | 6/2016 | Toyooka | H05B 37/0281 |
| 9,439,266 | B2 * | 9/2016 | Kang | G09G 3/342 |
| 9,583,049 | B2 * | 2/2017 | Takasaki | G09G 3/3406 |
| 9,591,720 | B2 * | 3/2017 | Asamura | H05B 37/0227 |
| 9,659,521 | B2 * | 5/2017 | Satake | G09G 3/2014 |
| 9,763,292 | B2 * | 9/2017 | Kang | H05B 33/0815 |
| 2010/0213856 | A1 | 8/2010 | Mizusako | |

FOREIGN PATENT DOCUMENTS

| | | | |
|---|---|---|---|
| JP | 2010-200427 | A | 9/2010 |
| JP | 2011-154841 | A | 8/2011 |
| JP | 2011-165578 | A | 8/2011 |
| JP | 2011-180455 | A | 9/2011 |
| JP | 2013-084519 | A | 5/2013 |

* cited by examiner

LUMINANCE CONTROL APPARATUS AND LUMINANCE CONTROL METHOD

CROSS REFERENCE TO RELATED APPLICATIONS

This application is a National Stage of International Application No. PCT/JP2015/083760 filed Dec. 1, 2015, claiming priority based on Japanese Patent Application No. 2014-265408 filed Dec. 26, 2014, the contents of all of which are incorporated herein by reference in their entirety.

BACKGROUND OF THE INVENTION

Field of the Invention

The present invention relates to a luminance control device and a luminance control method for controlling luminance of a light emitting member.

Description of the Related Art

Generally, a light-emitting element such as an LED element or an organic EL element may be controlled with fade-in processing or fade-out processing so that the luminance gradually changes. When the luminance of the light emitting element is controlled with pulse width modulation control, duty ratio of the pulse current or the pulse voltage for driving the light emitting element is changed in each of a plurality of unit periods within the luminance transition period. At this time, when the difference (variation width) of the reference duty ratio in the adjacent unit period is large, discontinuous changes tend to be visually recognized by the user, and there is a possibility of giving a sense of discomfort. On the other hand, in order to reduce the range of change in the reference duty ratio, it is necessary to divide the luminance transition period into a large number of unit periods, and to store the reference duty ratio every unit period, increasing the amount of information to be stored.

Therefore, disclosed is a luminance control device integrating the reference duty ratio every time a period shorter than the unit period elapses with the unit luminance variation width finer than the predetermined luminance variation width which is the difference between the reference duty ratios in the adjacent unit period (for example, refer to Patent Document 1). Such a luminance control device tries to alleviate the sense of discomfort given to the user by reducing the variation width of the luminance of the light-emitting element. Also, the reference duty ratio and the unit luminance variation range in each unit period may be stored, suppressing an increase in the amount of information.

CITATION LIST

Patent Document

[Patent Document 1] Japanese Patent Application Publication No. 2003-257694

SUMMARY OF THE INVENTION

Technical Problem

Incidentally, when the luminance of the light-emitting element changes stepwise, the larger the change rate of the luminance is, the easier a sense of discomfort becomes susceptible to the user. Therefore, the rate of change of luminance is made constant, that is, it is preferable to set smaller the ratios of the reference duty between unit periods of low luminance than between unit periods of high luminance unit. However, in the luminance control device described in Patent Document 1, the variation width and the unit luminance variation width are constant, and the rate of change of the luminance in the low luminance unit period becomes larger than that in the high luminance unit period, so that the discomfort cannot be sufficiently suppressed in some cases. Here, in order to reduce the variation width of the luminance in the unit period of low luminance, the lower the unit period of luminance, the more the unit luminance variation width is intended to decrease, requiring individually setting and storing the unit luminance variation width for each unit period, which results in an increase in the amount of information.

An object of the present invention is to provide an information processing apparatus and an information processing method capable of suppressing the amount of information to be stored, while controlling the luminance of the light-emitting element so as not to give a sense of discomfort to the user.

Solution to Problem

In order to resolve the above problem and to achieve the object, the invention according to a first aspect is a luminance control device for controlling luminance of a light emitting member by varying a duty ratio of a pulse current or a pulse voltage for driving the light emitting member in each of a plurality of unit periods into which a luminance transition period is equally divided, the luminance control device comprising: a duty ratio storage unit for storing a reference duty ratio in each of the plurality of unit periods; a division number storage unit for storing an interpolation division number; a calculation unit for calculating an interpolation variation width in one unit period by dividing by the interpolation division number a value obtained subtracting the reference duty ratio in the one unit period from the reference duty ratio in the next unit period among the plurality of unit periods; an integration unit for integrating the interpolation variation width into the reference duty ratio in the unit period every time an interpolation period elapses, the interpolation period in which the unit period is equally divided by the interpolation division number in each of the plurality of unit period; and a control unit for causing the light emitting member to emit light at the duty ratio determined by the integrating unit.

According to a second aspect of the present invention, in the first aspect of the present invention, the reference duty ratio in each of the plurality of unit periods is set to increase or decrease stepwise.

According to a third aspect of the present invention, in the second aspect of the invention, a difference between the reference duty ratio in the one unit period and the reference duty ratio in the next unit period among the plurality of unit periods is set decreased as the reference duty ratio of the one unit period becomes decreased.

According to a fourth aspect of the invention, in any one of the first to third aspects of the invention, the light emitting member comprises a plurality of light emitting elements having mutually different luminance colors, wherein the duty ratio storage unit stores the reference duty ratio for each of the luminance colors, wherein the calculation unit calculates the interpolation variation width for each of the luminance colors, wherein the integration unit integrates the interpolation variation width to the reference duty ratio for each the luminance color, and wherein the control unit causes the light emission to emit with the duty ratio for each of the light luminance colors determined by the integration unit.

According to a fifth aspect of the present invention, there is provided a method for controlling luminance of a light emitting member by varying a duty ratio of a pulse current or a pulse voltage for driving the light emitting member by each of a plurality of unit periods into which a luminance transition period is equally divided, the method comprising: storing a reference duty ratio and an interpolation division number in each of the plurality of unit periods; calculating an interpolation variation width in one unit period by dividing by the interpolation division number a value obtained subtracting the reference duty ratio in one unit period from the reference duty ratio in the next unit period among the plurality of unit periods; and the interpolation variation width into the reference duty ratio in the unit period every time an interpolation period elapses, into which the unit period is further divided by the interpolation division number in each of plurality of unit period, and causing the light emitting member to emit light at the duty ratio determined by the integrating unit.

Advantages of the Invention

According to the first aspect of the present invention, since in each of the plurality of unit periods, the interpolation variation width is integrated into the reference duty ratio every time the interpolation period passes, the variation width of the luminance of the light emitting member is made reduced, making it unlikely for users to feel uncomfortable. In addition, calculation of the interpolation variation width by dividing the obtained value by the number of interpolation divisions, the value being obtained subtracting the reference duty ratio in the one unit period from the reference duty ratio in the next unit period allows for storing the number and the reference duty ratio in each unit period in order to calculate the interpolation variation width, suppressing the amount of information to be stored. At this time, it is possible to calculate the interpolation variation width though the difference between the reference duty ratios in adjacent unit periods is not constant, allowing the reference duty ratio of each unit period to be appropriately set, and therefore the interpolation variation width in each unit period can be set to an appropriate value. For example, if the difference between the duty ratios with the next unit period in the low luminance unit period is made small, it is possible to reduce the interpolation variation width in the unit period of low luminance, furthermore unlikely giving the user an uncomfortable feeling. Note that the "difference" here means an absolute value.

According to the second aspect of the invention, since the reference duty ratio in each of the plurality of unit periods gradually increases or decreases, the luminance of the light emitting member is made gradually increased or decreased, allowing for executing a fade-in process or a fade-out process for example.

According to the third aspect of the invention, since the difference between the reference duty ratio in the one unit period and the reference duty ratio in the next unit period among the plurality of unit periods is set decreased as the reference duty ratio of the one unit period becomes decreased, it is possible that the lower the luminance the more the variation width of the luminance for the unit period is reduced, making smaller the variation width of the luminance of the emitting member, which reduces possibility for the user to feel uncomfortable.

According to the fourth aspect of the present invention, since the light emitting member comprises a plurality of light emitting elements having mutually different luminance colors, and the control unit causes the light emission to emit with the duty ratio for each of the light luminance colors determined by the integration unit, it is possible for the light emitting member to emit light with an appropriate luminescent color after adjusting adequately the balance of the luminance of the light-emitting element for each luminescent color, and to vary the luminance so as for the user not to feel uncomfortable.

According to the fifth aspect of the present invention, since the method includes calculating an interpolation variation width in one unit period by dividing by the interpolation division number a value obtained subtracting the reference duty ratio in one unit period from the reference duty ratio in the next unit period; integrating the interpolation variation width into the reference duty ratio in the unit period and varying the luminance of the light-emitting element, the amount of information to be stored is suppressed as described above, and the luminance of the light emitting element can be changed so as not to give the user a sense of discomfort.

DESCRIPTION OF EMBODIMENTS

Figure 1:
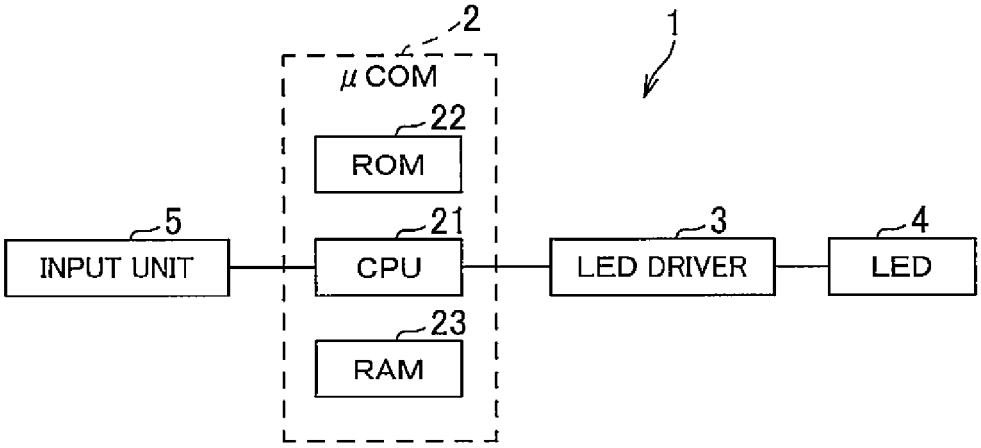
FIG. 1 is a configuration diagram showing a luminance control device according to an embodiment of the present invention.

Hereinafter, each embodiment of the present invention will be described with reference to the drawings. The luminance control device 1 of the present embodiment, as shown in FIG. 1, includes a microcomputer 2 (hereinafter referred to as μCOM 2) and an LED driver 3 as a control unit for receiving a signal and lighting the LED 4 as a light emitting member, and is mounted on, for example, a not-shown vehicle, and controls lighting or lights-out of the LED 4 and the luminance thereof upon lighting.

The μCOM 2 includes a central processing unit 21 (hereinafter referred to as CPU 21) executing various processes according to the program, and a read-only storage unit ROM 22 storing a program of processing executed by the CPU 21, a writeable and readable memory RAM 23 having a work area used in various processing and a data storing area storing various data in the CPU 21. Further, an input unit 5 is connected to the CPU 21.

The ROM 22 stores a fade table for fade-in processing shown in Table 1 and functions as a duty ratio storage unit by storing the fade table for fade-out processing, and functions as a division number storing unit by storing the interpolation division number Nd. In the fade-in processing, the reference duty ratio in each of the plurality of unit periods is set to increase stepwise, and in the fade-out process, the reference duty ratio in each of the plurality of unit periods is set to decrease stepwise.

TABLE 1

| | REFERENCE DUTY RATIO Dn |
|---|---|
| ZEROTH UNIT PERIOD | 0 |
| FIRST UNIT PERIOD | 5 |
| SECOND UNIT PERIOD | 15 |
| THIRD UNIT PERIOD | 30 |
| FOURTH UNIT PERIOD | 60 |
| FIFTH UNIT PERIOD | 100 |

In the present embodiment, the length TW of the luminance transition period in which the fade-in process is performed is 0.5 seconds, and the length T of each unit period is set to 0.1 seconds, and the luminance of the LED 4 is changed. Assume that the interpolation division number Nd is 10 and the interpolation period ΔT obtained by dividing the unit period T by the interpolation division number Nd is 0.01 seconds. Also, as shown in Table 2, the more the reference duty ratio Dn decreases, the smaller the difference ΔDn from the reference duty ratio Dn+1 of the unit period is set. Further, the more the reference duty ratio Dn decreases, the smaller becomes the interpolation variation width Dn' obtained by dividing by the interpolation division number Nd the value obtained by subtracting the reference ratio Dn from the reference ration Dn+1.

TABLE 2

| | DIFFERENCE Δ Dn OF REFERENCE DUTY RATIO FROM NEXT UNIT PERIOD | INTERPOLATION VARIATION WIDTH Dn' |
|---|---|---|
| ZEROTH UNIT PERIOD | 5 | 0.5 |
| FIRST UNIT PERIOD | 10 | 1.0 |
| SECOND UNIT PERIOD | 15 | 1.5 |
| THIRD UNIT PERIOD | 30 | 3.0 |
| FOURTH UNIT PERIOD | 40 | 4.0 |
| FIFTH UNIT PERIOD | — | — |

The LED driver 3 is configured to be connected to a not shown power supply and to turn on the LED 4 by pulse width modulation control, adjusting of pulse current for driving the LED 4 or a pulse voltage duty allows for controlling the luminance of the LED 4. The LED driver 3 drives the LED 4 at the duty ratio corresponding to the signal received from the μCOM 2.

The LED 4 has a plurality of LED elements as light emitting element, is configured to emit light with a predetermined luminance color, and is used as an indoor lighting of a vehicle for example.

The input unit 5 is connected to, for example, unit for detecting the opening and closing of the vehicle door, an ON signal, when the vehicle door is opened, is transmitted to the μCOM 2, an OFF signal, when the vehicle door is closed, is transmitted to the μCOM 2. Note that the input unit 5 may be configured such as to continue to transmit the ON signal while the vehicle door is open, and not to transmit the signal while the vehicle is closed, and it is also preferable the input unity 5 is connected to other parts of the vehicle so as to transmit the ON signal at an appropriate timing.

Hereinafter, as the luminance control method for controlling the luminance of the LED 4, an example of a fade-in process on μCOM 2 will be described with reference to the flowchart of FIG. 2. Incidentally, a fade-out process is enough to read the fade table for the fade-out processing, and is executed as the same process as the following fade-in process.

Figure 2:
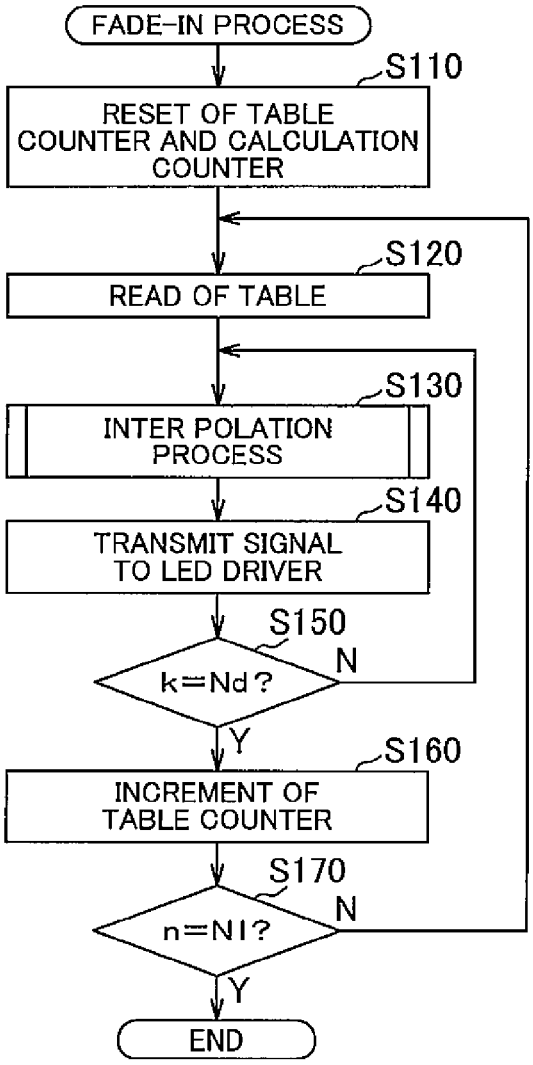
FIG. 2 is a flowchart showing an example of fade-in process executed by a CPU of a microcomputer included in the luminance control apparatus of FIG. 1.

The CPU 21 of the μCOM 2, when the vehicle door opens and ON signal is received from the input unit 5, starts the fade-in process shown in FIG. 2. In the case of fade-out processing, the CPU 21 receives an OFF signal or stops receiving an ON signal, thereby performing the process.

Upon starting the fade-in process, the CPU 21 resets at that point the table counter for storing the value of n indicating the nth unit period and the calculation counter for storing an integration number k of the interpolation variation width described later (S110). Namely, the table counter is set to "n=0", the calculation counter is set to "k=0".

Next, the CPU 21 reads the reference duty ratio Dn of the next n+1 unit period and the reference duty ratio Dn+1 of the n+1th unit period from the fade table for fade-in processing stored in the ROM 22 (S 120).

Figure 3:
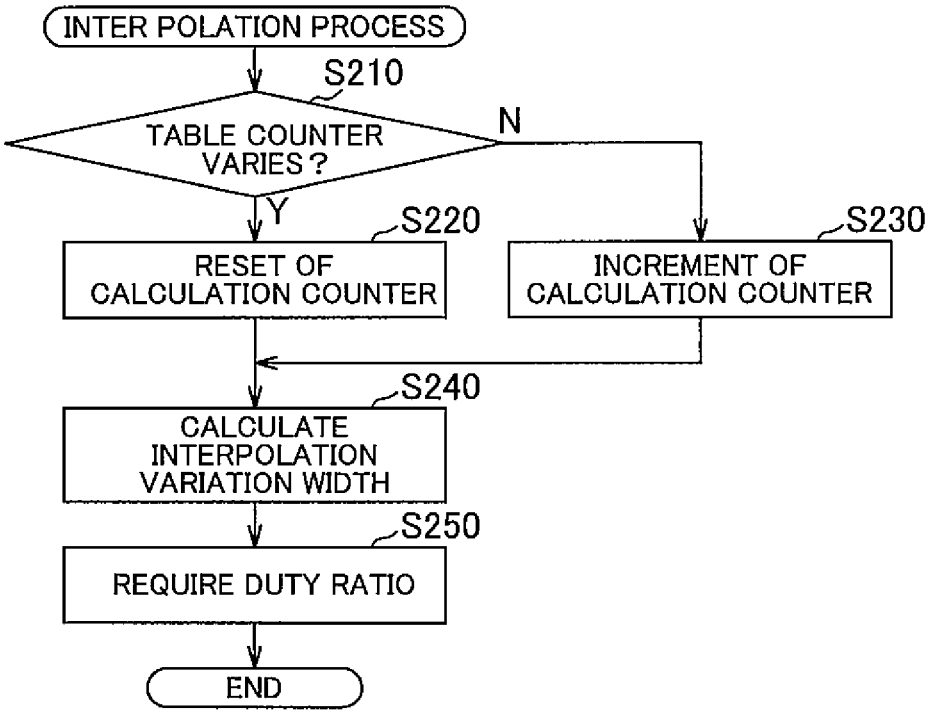
FIG. 3 shows an example of an interpolation process executed by a CPU during the fade-in process of FIG. 2.

Next, the CPU 21 executes the interpolation processing shown in FIG. 3 (S130). The CPU 21, when starting the interpolation processing, firstly determines whether the table counter value n has changed (that is, whether or not step S160 described later has passed) immediately before the transition to the interpolation processing (S210). When n has changed (Y in S210), the CPU 21 resets the value of the operation counter to set it to "k=1" (S220), and if n has not changed (N in S210), increment the value k of the counter by one (S230).

Next, the CPU 21 divides a value obtained by subtracting the reference duty ratio Dn in the nth unit period from the reference duty ratio Dn+1 in the n+1th unit period by the interpolation division number Nd to obtain the interpolation variation width DN' (S240).

Next, the CPU 21 adds a value gained by multiplying the interpolation variation width Dn' by a value k of the calculation counter, to the reference duty ratio Dn of the nth unit period, obtains the duty ratio D at that point in time (S250), and ends the interpolation process. In the nth unit period, every time one interpolation process is executed K increases by one, so that the duty ratio D increases by the interpolation variation width Dn every one interpolation process, that is, the interpolation variation width Dn' is integrated to the reference duty ratio Dn.

Upon completion of the interpolation processing, the CPU 21 returns to the fade-in processing again and transmits a signal to the LED driver 3 so as to light the LED 4 at the duty ratio D obtained in S250 (S140). Incidentally, the LED driver 3, until again receiving a signal from the CPU 21, continues to light the LED 4 at the certain duty ratio. Further, the CPU 21 has a timer function, and waits at an appropriate timing in the fade-in process so as to transmit the signal to the LED driver 3 at an interval of the interpolation period ΔT every time the process reaches step S140.

Next, the CPU 21 determines whether or not the value k of the calculation counter is equal to the interpolation division number Nd (S150). If the value k of the calculation counter is not equal to the interpolation division number Nd (N in S150), the CPU 21 determines that the nth unit period continues and returns to the step S130. On the other hand, when the value k of the calculation counter is equal to the interpolation division number Nd (Y in S150), CPU 21 determines that the nth unit period has ended and increments the value n of the table counter by one (S160).

Following step S160, the CPU 21 determines whether or not the table counter value n is equal to N1 indicating the last unit period (5 in this embodiment) (S170).

When the value n of the table counter is not equal to N1 (N in S 170), the CPU 21 returns to step S120 again. When the table counter value n is equal to N1 (Y in S170), the CPU 21 ends the fade-in processing.

The CPU 21 executing the processing of step S240 in the flowchart of FIG. 3 corresponds to the CPU 21, the CPU 21 executing the process of S250 corresponds to the multiplying unit.

Figure 4:
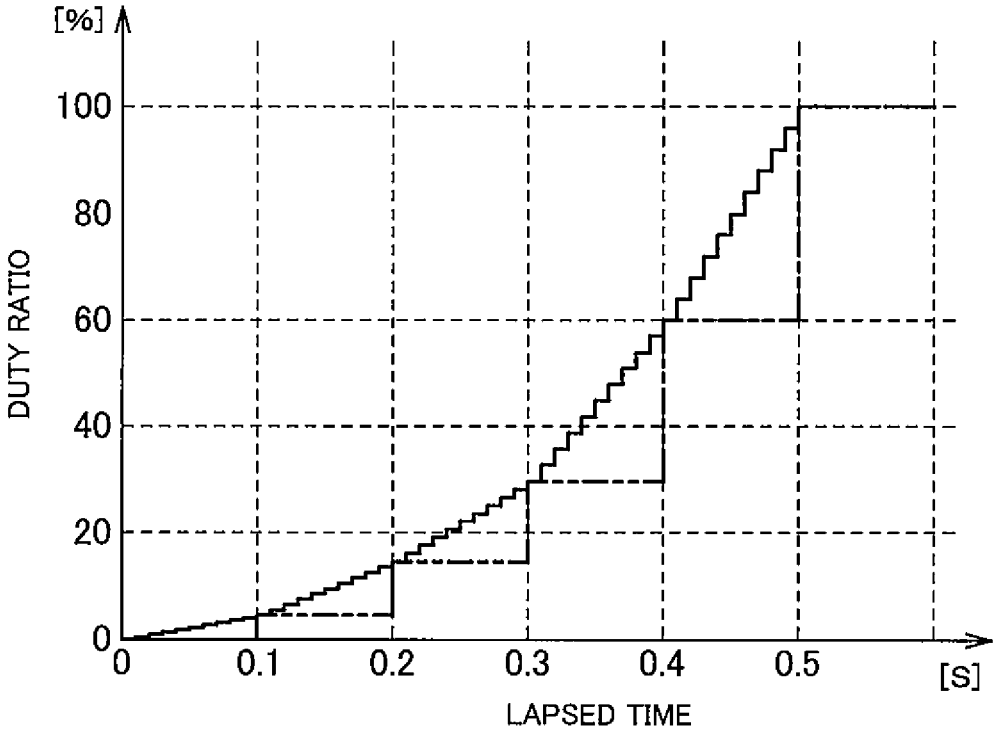
FIG. 4 is a graph showing temporal change in duty ratio in the fade-in process of FIG. 2.
Figure 5:
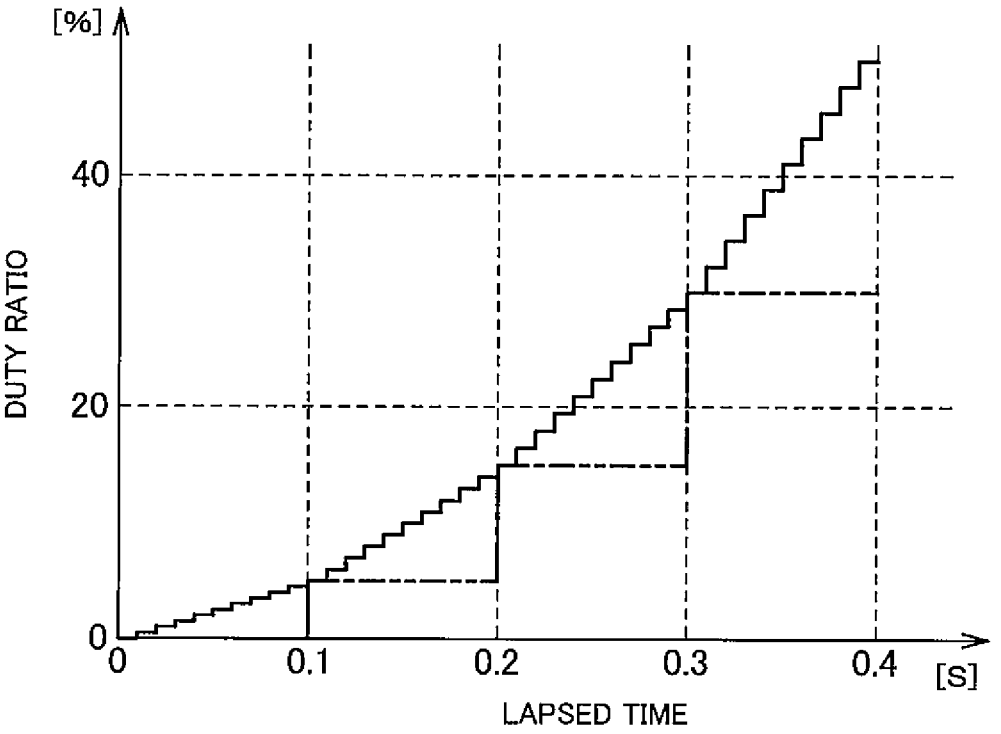
FIG. 5 is an enlarged graph showing a main part of the graph of FIG. 4.

By performing the fade-in process as described above, the ratio D for driving the LED 4 becomes a value multiplying the reference duty ratio Dn by the interpolation variation width Dn' every time the interpolation period ΔT elapses so as to change with age as indicated by the solid line in FIGS. 4 and 5. That is, as the duty ratio D in each unit period increases by the interpolation variation width Dn', and as N becomes large, the interpolation variation width Dn' also increases.

According to this embodiment as described above, the following effects are obtained. That is, in the fade-in processing and the fade-out processing, when the luminance of the LED 4 is changed, the duty ratio D changes by the interpolation variation width Dn', reducing the variation of the luminance of the LED 4, which certainly reduces discomfort of the user. At this time, in order to calculate the interpolation variation width Dn', the number Nd and the reference duty ratio Dn in each unit period may be stored, suppressing the information amount, which allows to calculate the interpolation variation width Dn' even though the difference ΔDn of the reference duty ratio Dn in the adjacent unit period is not constant. Further, the CPU 21 can calculate the interpolation variation width Dn' with easy calculation of subtraction, division, and addition.

Furthermore, as the reference duty ratio Dn decreases, the interpolation variation width Dn' also decreases, suppressing increase of the rate of change in the luminance of the LED 4 in a unit period in which the luminance of the LED 4 is low, further making it unlikely for the user to feel uncomfortable.

It is to be noted that the present invention is not limited to the above embodiment, and includes other configurations with which the object of the present invention can be achieved, and the following modifications and the like are included in the present invention.

For example, in the above embodiment, the luminance control device 1 is to control the LED 4*a* as light emitting member capable of emitting light with a predetermined luminance color, but the light emitting member may be configured so that the whole luminescent color can be adjusted by including a plurality of light emitting elements having different luminescent color from each other, for example, an LED having LED elements of three primary colors of RGB. At this time, the ROM may store the fade table every three primary colors, and the CPU may calculate the interpolation variation width for each light luminance color, calculate the interpolation variation width every luminescent color and add to the reference duty ratio of each luminescent color individually, require the duty ratio for each luminescent color, and cause each LED to emit light with duty ratio of every luminance color. According to this configuration it is possible to adjust a balance of the luminance of the LED element of each luminescent color, causes wholly the LED to emit light with adequate luminance color, and change the luminance so as for the user not to feel uncomfortable.

Further, in the above embodiment, it is exemplified that as the luminance control method, the luminance is controlled by the fade-in processing and the fade-out processing, however, the change in the reference duty ratio in the luminance control method may be appropriately set, for example, the duty ratio may be changed so as to increase the luminance from the state where the light emitting member is emitting light, or that the ratio may be changed to decrease to a degree not to turn off. Further, for example, so as to lower the luminance after once being increased, the duty ratio may be changed so that the luminance does not increase or decrease monotonously.

Further, in the above-described embodiment, the luminance control device 1 is provided in the vehicle, but the luminance control device may be provided so as to control the luminance of a suitable light emitting member, and may control, for example, the luminance of the light emitting member provided on the display section such as a meter panel or may control the luminance of the indoor lighting of the house. In addition the light emitting member is limited to LED elements, but for example it may have an organic EL element, or the one in which the luminance can be controlled by controlling the duty ratio.

In addition the best configurations, methods, and the like for carrying out the present invention are disclosed in the above description, however, the present invention is not limited to this. That is, the present invention is mainly illustrated and described to a specific embodiment, it is to be understood that without departing from the spirit and scope of the invention various modifications can be made by those skilled in the art in the shape, material, quantity, other fine configuration with respect to the above-described embodiments. Therefore, since the description that limits the shape and material disclosed above is to facilitate the understanding of the present invention, but not limit the present invention, the description with the name of a member of which part or all definite part such as the shape and material is excluded, is included in the present invention.

DESCRIPTION OF SYMBOLS

1 luminance control device
3 LED driver (control unit)
4 LED (light emitting member)
21 CPU (calculating unit, integrating unit)
2 ROM (duty ratio storage unit, division number storage unit)

What is claimed is:

1. A luminance control device for controlling luminance of a light emitting member by varying a duty ratio of a pulse current or a pulse voltage for driving the light emitting member in each of a plurality of unit periods into which a luminance transition period is equally divided, the luminance control device comprising:

a duty ratio storage unit for storing a reference duty ratio in each of the plurality of unit periods;

a division number storage unit for storing an interpolation division number;

a calculation unit for calculating an interpolation variation width in one unit period by dividing by the interpolation division number a value obtained subtracting the reference duty ratio in the one unit period from the reference duty ratio in the next unit period among the plurality of unit periods;

an integration unit for integrating the interpolation variation width into the reference duty ratio in the unit period every time an interpolation period elapses, the interpolation period in which the unit period is equally divided by the interpolation division number in each of the plurality of unit periods; and a control unit for causing the light emitting member to emit light at the duty ratio determined by the integrating unit.

2. The method according to claim 1, wherein the reference duty ratio in each of the plurality of unit periods is set to increase or decrease stepwise.

3. The method according to claim 2, wherein a difference between the reference duty ratio in the one unit period and the reference duty ratio in the next unit period among the plurality of unit periods is set decreased as the reference duty ratio of the one unit period becomes decreased.

4. The method according to claim 1, wherein the light emitting member comprises a plurality of light emitting elements having mutually different luminance colors, wherein the duty ratio storage unit stores the reference duty ratio for each of the luminance colors, wherein the calculation unit calculates the interpolation variation width for each of the luminance colors, wherein the integration unit integrates the interpolation variation width to the reference duty ratio for each the luminance color, and wherein the control unit causes the light emission to emit with the duty ratio for each of the light luminance colors determined by the integration unit.

5. A method for controlling luminance of a light emitting member by varying a duty ratio of a pulse current or a pulse voltage for driving the light emitting member by each of a plurality of unit periods into which a luminance transition period is equally divided, the method comprising:

storing a reference duty ratio in each of the plurality of unit periods and an interpolation division number;

calculating an interpolation variation width in one unit period by dividing by the interpolation division number a value obtained subtracting the reference duty ratio in the one unit period from the reference duty ratio in the next unit period among the plurality of unit periods; and integrating the interpolation variation width into the reference duty ratio in the unit period every time an interpolation period elapses, into which the unit period is further divided by the interpolation division number in each of the plurality of unit periods, and causing the light emitting member to emit light at the duty ratio determined by the integrating unit.

* * * * *